US006543540B2

(12) United States Patent
Woie et al.

(10) Patent No.: US 6,543,540 B2
(45) Date of Patent: Apr. 8, 2003

(54) METHOD AND APPARATUS FOR DOWNHOLE PRODUCTION ZONE

(75) Inventors: Rune Woie, Hafrsfyord (NO); Harald Grimmer, Lachendorf (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/754,944

(22) Filed: Jan. 5, 2001

(65) Prior Publication Data

US 2001/0050170 A1 Dec. 13, 2001

(Under 37 CFR 1.47)

Related U.S. Application Data

(60) Provisional application No. 60/174,777, filed on Jan. 6, 2000.

(51) Int. Cl.[7] ..... E21B 43/26; E21B 43/16; E21B 47/00; E21B 49/08

(52) U.S. Cl. ..... 166/305.1; 166/250.02; 166/264; 166/250.01; 166/308

(58) Field of Search ..... 166/106, 169, 166/250.17, 264, 313, 250.02, 250.01, 308, 305.1, 252.1

(56) References Cited

U.S. PATENT DOCUMENTS 5,335,732 A * 8/1994 McIntyre ..... 166/250.01
5,803,186 A * 9/1998 Berger et al. ..... 166/250.17
5,831,156 A * 11/1998 Mullins ..... 166/250.17
5,857,519 A * 1/1999 Bowlin et al. ..... 166/105.6

FOREIGN PATENT DOCUMENTS

| | | |
|---|---|---|
| EP | 0 697 500 A | 2/1996 |
| EP | 1 041 244 A | 10/2000 |
| WO | WO 98 48186 | 10/1998 |

* cited by examiner

*Primary Examiner*—David Bagnell
*Assistant Examiner*—Brian Halford
(74) *Attorney, Agent, or Firm*—Madan, Mossman & Sriram, P.C.

(57) ABSTRACT

The present invention provides systems and methods for performing production testing in open holes and in cased holes that avoid transporting formation fluid to the surface. The invention essentially comprises a test string for testing a production zone intersecting a wellbore. The string further comprises a fluid communication member allowing flow of fluid therethrough, a sealing device for isolating a production zone intersecting the wellbore to allow fluid flow from the production zone into the fluid communication member, a second sealing device spaced apart from the first sealing device for isolating a second injection zone intersecting the wellbore, a pump for pumping fluid between zones, and flow control devices.

24 Claims, 8 Drawing Sheets

METHOD AND APPARATUS FOR DOWNHOLE PRODUCTION ZONE

CROSS REFERENCE TO RELATED APPLICATION

This application claims priority from U.S. Provisional Patent Application No. 60/174,777, filed on Jan. 6, 2000.

BACKGROUND OF THE INVENTION

1. Field of the Invention

This invention relates generally to oilfield well testing and more particularly to production testing of wells wherein fluid from a production zone is injected into a another subsurface zone.

2. Description of the Related Art

After drilling of a well to a known depth, a production zone or zones are identified by a variety of known techniques. "Production test" or "production testing" is carried out to obtain data to determine a variety of characteristics of the oil and gas reservoirs, including the flow characteristics of the reservoir fluid, such as permeability.

A variety of production testing methods are known. Production tests are performed prior to completing a well (in open holes) as well as in cased or completed wells. Usually, a production test has two phases, each with a duration of several hours to a few days. In the beginning, the fluid adjacent the production zone flows into the well, but gradually the fluid from greater distances must flow into the well. The pressure in the well decreases because the fluid must flow over a longer distance through the formation, subjecting it to increasing pressure loss. When a constant flow rate from a particular zone is maintained, then the pressure in the well depends only on the character of the formation. During the first phase of a production test, pressure and temperature measurements over time are recorded, during constant flow rate. In the second phase of the production test, the fluid flow from the production zone being tested is stopped. The pressure within the well then gradually rises to the formation pressure as the formation around the well is filled with the fluid from the remote areas. The pressure build up over time and temperature overtime are recorded. The pressure overtime, temperature over time and the flow rate measurements are most commonly used to analyze the reservoir characteristics.

During the first phase of the production testing, the reservoir fluid is conducted to the surface via a tubing. Packers in the annulus between the tubing and the well are placed to seal the annulus so the formation fluid will flow through the tubing and not through the annulus. A flow control valve at the upper end of the tubing at the surface is used to control the flow of the fluid from the formation. Downhole pumps are sometimes installed to maintain the desired fluid flow rate. The above-described and other known production testing methods usually require flowing substantial amounts of formation fluid to the surface during the first phase of the production test. Such methods suffer from a number of disadvantages.

In open hole wells, there usually are no or very inadequate facilities at the surface to process the formation fluid brought to the surface. The reservoir fluid poses safety risks as it is flammable and hazardous to the environment. Therefore, substantial safety measures are taken in connection with such production tests. To reduce the environmental risks, the reservoir fluid is usually burned off at the well site. Combustion of hydrocarbons, however, produces unwanted gases which pollute the environment. Hydrocarbons also are often discharged into the environment. These problems are exasperated for offshore wells. In certain regions, such as the Norwegian Continental shelf, regulations restrict or prohibit burning of polluting matters. The operators in such regions collect the produced reservoir fluid and transport it to suitable offsite processing plants. Accordingly, it is increasingly becoming important to devise production testing methods which are safe, environmentally friendly and less weather dependent.

Before conducting production testing, casing is often cemented in the well to insulate various permeable layers, and to comply with safety requirements. Usually, special production tubing is used down to the layer/bed (zone) to be tested. These preparations are time-consuming and expensive. Safety considerations make it sometimes necessary to strengthen an already set casing, perhaps over the entire or a substantial part of the length of the well; particularly in high pressure wells where it might be required to install extra casings in the upper parts of the well.

It can be difficult to secure a good cementing. Channels, cracks or voids my exist in the cemented zones. In many cases, it is difficult to define or measure the quality of the cementing operation or the presence of cement. Unsatisfactory cementing can cause so-called cross flows to or from other permeable formations outside the casing. Cross flows may, to a high degree, influence the measurements carried out. Time-consuming and very expensive cementing repairs might be required in order to eliminate such sources of errors.

Systems currently used can be adequate for take care of drilling wells in deep waters, but do not provide safe and secure production testing. In deep water operations, it is difficult to remain secure when the drilling vessel drifts out of position, or whenever the riser is subjected to large, uncontrollable and not measurable vibrations or leeway. Such a situation requires a rapid disconnection of the riser or production tubing subsequent to closing the production valve at the seabed.

Further, in ordinary production it is usual to use various forms of well stimulation. Such stimulation may include injection of chemicals into the formation in order to increase the flow rate. A simple well stimulation includes subjecting the formation to pressure pulses so that it cracks and, thus, becomes more permeable. Such methods are referred to as "fracturing" of the formation. A side-effect of fracturing can be a large increase in the amount of sand accompanying the reservoir fluid. In connection with production testing, it may in some instances be of interest to be able to effect a well stimulation in order to observe the effect thereof. Again, the case is such that an ordinary production equipment is adapted to avoid, withstand, resist and separate out sand, while corresponding measures are of less importance when carrying out a production test.

In some cases, it is useful to be able to carry out a reversed production test, i.e., pumping produced fluid back into the production formation. However, this presupposes that produced fluid can be kept at approximate reservoir pressure and temperature. This will require extra equipment, and it will be necessary to use additional safety measures. Further, it would require transfer of the production tubing. Probably, the production tubing would have to be pulled up and set once more, in order to give access to another formation. This is time-consuming as well as expensive. Therefore, it is not of actual interest to use such reversed production tests in connection with prior art techniques. During a reversed production test, a pressure increase is observed in the well while a reversed constant fluid flow is maintained. When the reversed fluid flow is interrupted, a gradual pressure reduction will be observed in the well. Reversed production test may contribute to revealing a possible connection in the rock ground between formations connected by the channel, and may in some cases also contribute to defining the distance from the well to such a possible connection between the formations.

The present invention provides systems and methods for performing production testing in open holes and in cased holes that avoid transporting formation fluid to the surface.

SUMMARY OF THE INVENTION

A main feature of the invention is that formation fluid is conducted from a first, expected permeable formation to a second permeable formation as opposed to prior art technique where fluid is conducted between a formation and the surface. According to the invention, prior to a production test, at least one channel connection is established between two formations, of which one (a first) formation is the one to be production tested. Further, sealing devices are disposed to limit the fluid flow between the formations through the channel connection(s). When fluid flow takes place from the first to the second formation the sealing devices, e.g. annulus packers, prevent fluid from flowing between the formations, outside the channel(s).

Within the channel, flow controlling devices are disposed, which may include flow control valves and a pump, operable from the surface in order to control the fluid flow in the channel and, thus, between the formations. Further, within the channel, a flow rate sensor is disposed. This sensor may be readable from a surface location.

Additionally, sensors adapted to determine pressure, temperature, detect sand, water and the like from the surface may be disposed. Of course, several sensors of each type may be disposed in order to monitor the desired parameters at several places within the channel. As discussed, sensors for pressure and temperature are disposed within the well. Likewise, equipment for timekeeping and recording of the measured valves are positioned in the well.

During a production test, by using the flow rate sensor, the adjustable valve and, possibly, by use of said pump, a constant fluid flow is established and maintained in the channel, for fluid flowing from one formation to the other formation. Pressure and other well parameters are read and recorded as stated above. Thereafter, the fluid flow is ceased, and the pressure build up within the well is monitored and recorded as stated. This production test may be extended to a reversed flow through the utilization of a reversible pump so that fluid can be pumped in the opposite direction between the two formations.

Storing produced reservoir fluid in a formation results in the advantage that the fluid may have approximately reservoir conditions when it is conducted back into the reservoir. Further, according to the invention, well stimulating measures in the formation being production tested may be used. Fracturing may be achieved by methods known in the art. To this end, the well is supplied with pressurized liquid, e.g., through a drill string coupled to the channel. Thereafter, a production test is carried out as described above. Additionally, a reversed production test may be conducted to obtain the production testing data from two separated layers without having to remove the test string.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENTS

Figure 1:
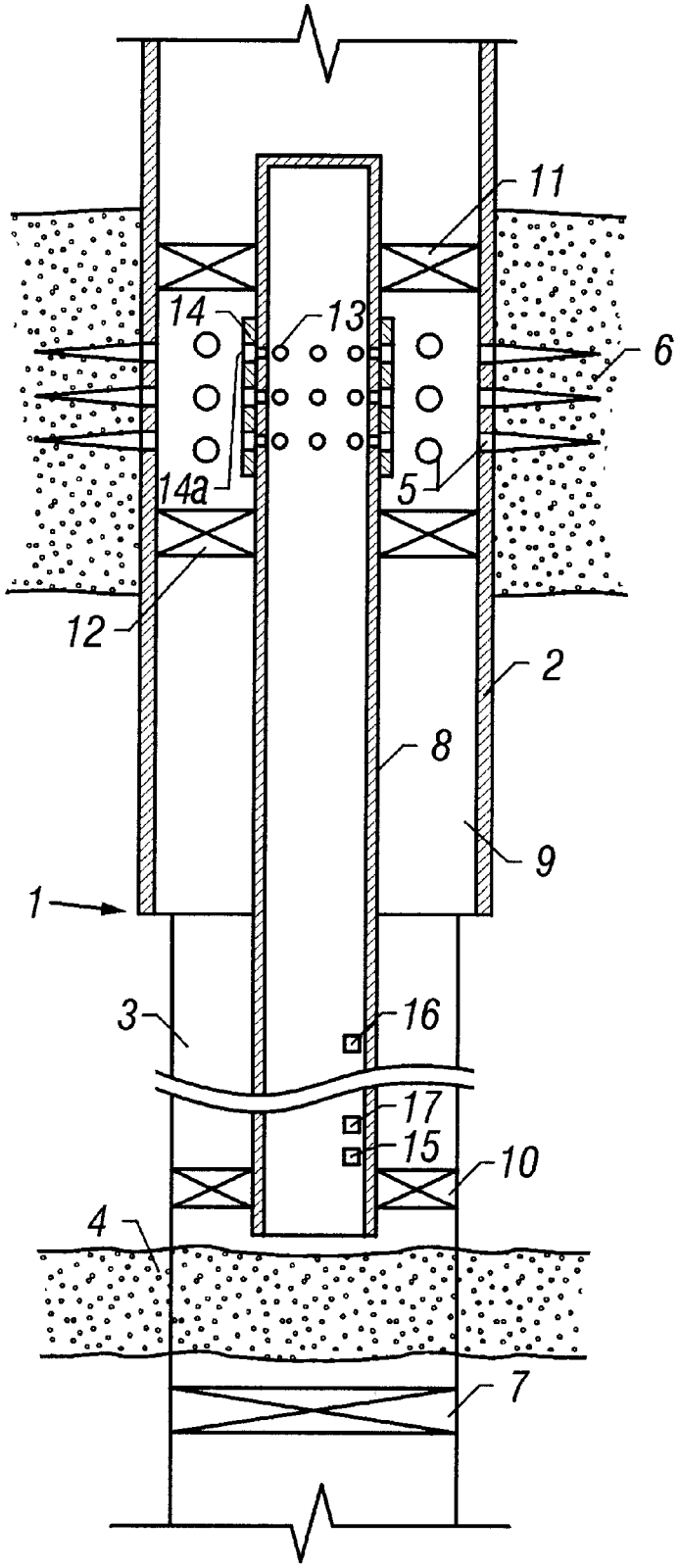
FIG. 1 shows, diagrammatically and in a side elevational view, a part of a sketch of a well where a channel has been disposed which connects two permeable formations.

In FIG. 1, reference numeral 1 denotes a part of a vertical well lined with a casing 2. The well 1 is extended with an open (not lined) hole 3 drilled through a first, expected permeable formation 4 to be production tested. The casing 2 is provided with a perforation 5 in an area where the well 1 passes through a second, permeable formation 6. According to FIG. 1A, second permeable formation 6 is not insulated or isolated by the casings 2. One or both permeable formations 4 and 6 may be stimulated using chemicals or may be fractured using a fracture mechanism (not separately shown) to increase flow in the formations 4 and 6. A well known device and method of fracturing a formation is a pump used to initiate pressure pulses for causing cracks to form in the formation.

First formation 4 is insulated from possible permeable formations adjacent the bottom of the well by a bottom packer 7. A tubular channel 8 extends concentrically with the well 1 from the area at first formation 4 to a place above the perforations 5. Thus, an annulus 9 is formed between the channel 8 and the casing 2.

A lower annular packer 10 placed further from the bottom of the well 1 than first permeable formation 4, defines the lower end of the annulus 9. An upper annular packer 11 placed further from the bottom of the well 1 than the perforations 5, defines the upper end of the annulus 9. An intermediate annular packer 12 placed closer to the bottom of the well 1 than the perforations 5, prevents communication between the perforations 5 and possible other permeable formations above the lower packer 10.

Figure 2:
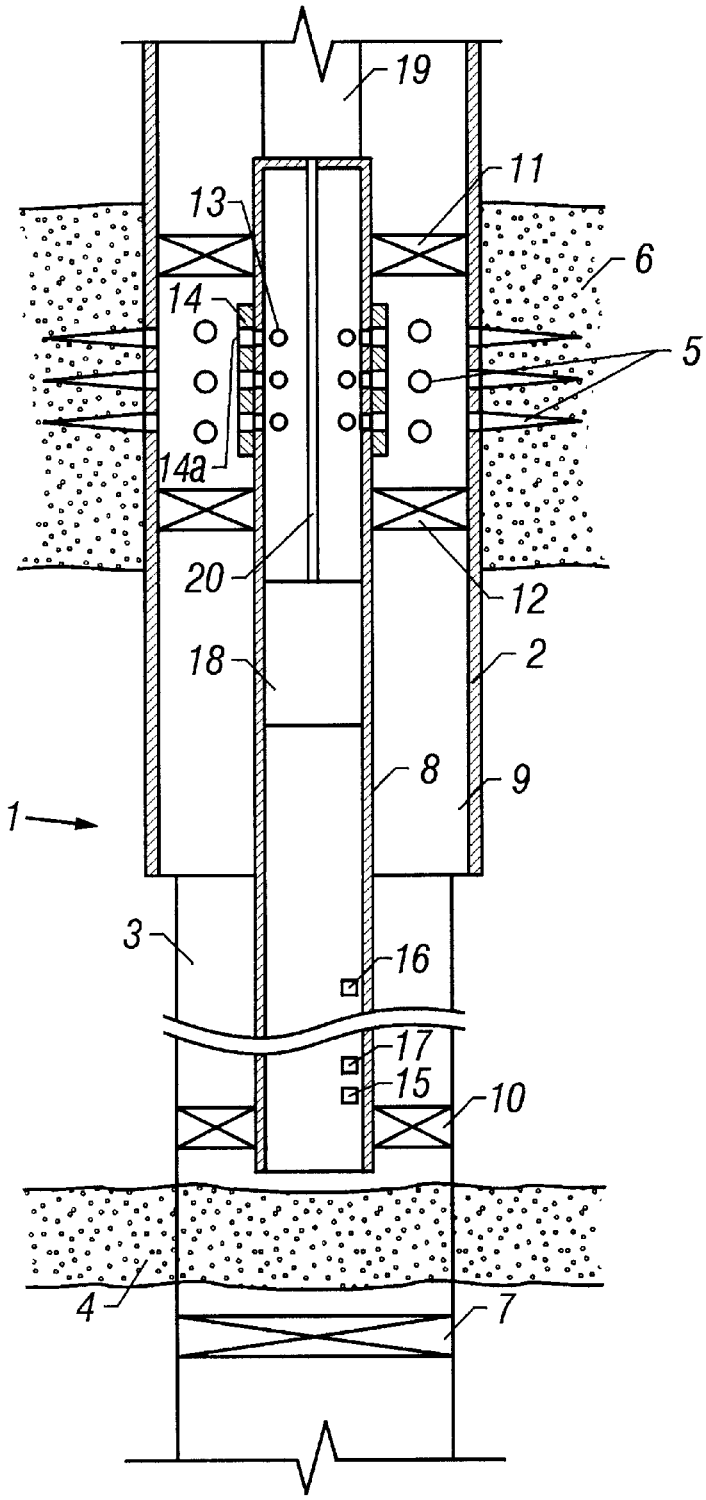
FIG. 2 shows a part of a well having a channel, corresponding to FIG. 1, and where a pump has been disposed.

The channel 8 is closed at the upper end and, according to FIGS. 1 and 2, open at the lower end. In an area distanced from the upper end of the channel 8, below the place where the upper packer 11 is mounted, the channel 8 is provided with gates 13 establishing a fluid communication between the channel 8 and the annulus 9 outside the channel. Thus, fluid may flow from the first formation 4 to the well 1 and into the channel 8 at the lower end thereof, through the channel 8 and out through the gates 13 and further, through the perforations 5, to second formation 6.

Figure 1A:
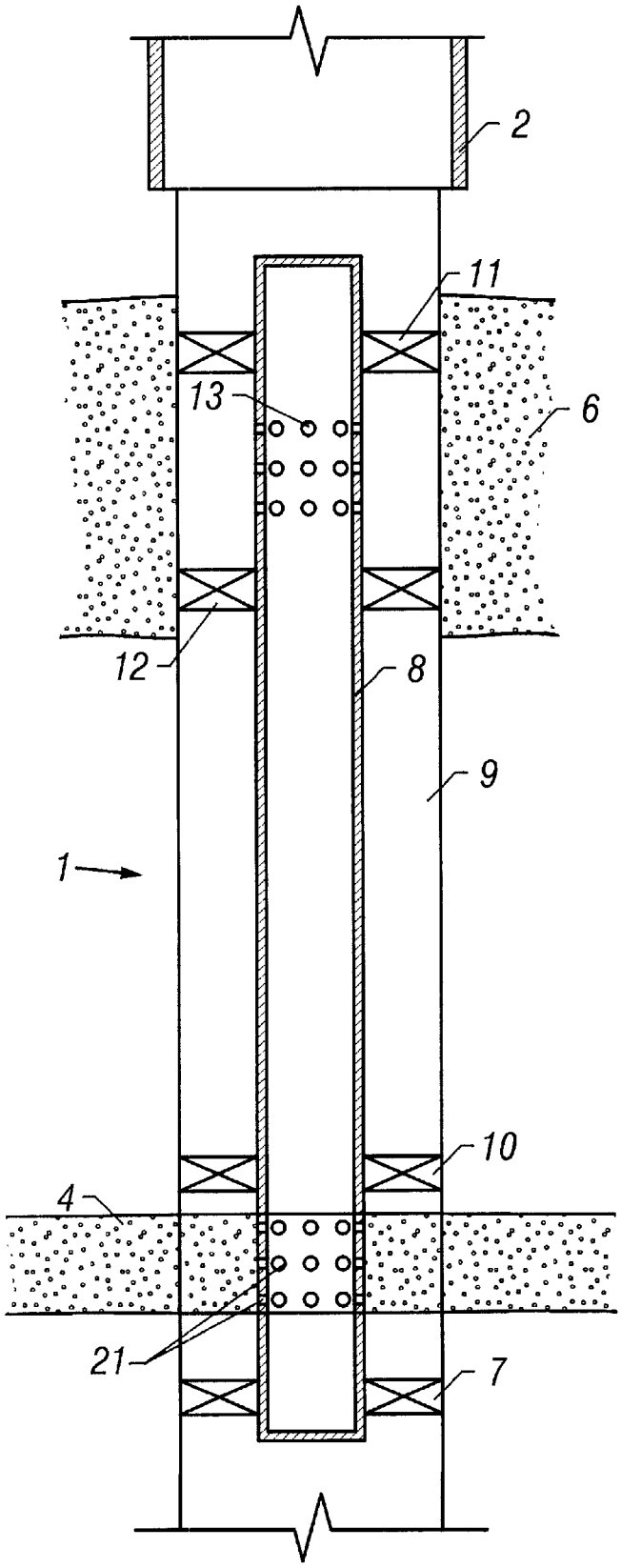
FIG. 1A corresponds to FIG. 1, but here is shown a minor modification of the channel-forming pipe establishing the fluid flow path between the two formations, the borehole through said second formation not being lined.

In accordance with FIG. 1A, there is no need here for the perforations 5 as in FIGS. 1 and 2. The annulus packers 11 and 12 will then act against the wall defining the borehole. The packer 7 can also be a part of the channel-forming pipe 8 when the pipe wall is perforated 21 between the packer 7 and the packer 10.

When the annulus packer 7 is mounted to the channel-forming pipe 8, the latter may be closed at the lower end thereof which, according to FIG. 1A, is positioned below the first, expected permeable formation layer 4. In an area above the annulus packer 7, the channel-forming pipe 8 is, thus, provided with through-going lateral gates 21 which, together with the through-going lateral gates 13, establish fluid communication between the formations 4 and 6.

Referring to FIG. 1, in the channel 8, a remotely operable valve (not shown) is disposed, said valve being adapted to control a fluid flow through the channel 8. The valve may, as known per se, comprise a remotely operated displaceable, perforated sleeve 14 adapted to cover the gates 13, wholly or in part, the radially directed holes 14*a* of the sleeve 14 being brought to register more or less with the gates 13 or not to register therewith.

Further in FIG. 2, in the channel 8, remotely readable sensors are disposed, inclusive a pressure sensor 15, and a flow sensor16 and a temperature sensor 17. The channel 8 may be assigned a pump 18 adapted to drive a flow of fluid through the channel 8.

The pump can be driven by a motor 19 placed in the extension of the channel 8. As known, a drive shaft 20 between motor 19 and pump 18 is passed pressure-tight through the upper closed end of the channel 8. Advantageously, the motor 19 may be of a hydraulic type, adapted to be driven by a liquid, e.g. a drilling fluid which, as known, is supplied through a drill string or a coilable tubing, not shown. Also, an electrical motor can be used which can be cooled through the circulation of drilling liquid or through conducting fluid flowing in the channel 8, through a cooling jacket of the motor 19.

In the annulus 9, sensors may be disposed, in order to sense and point out communication or cross flowing to or from the permeable layers, above or below the annulus.

Figure 3:
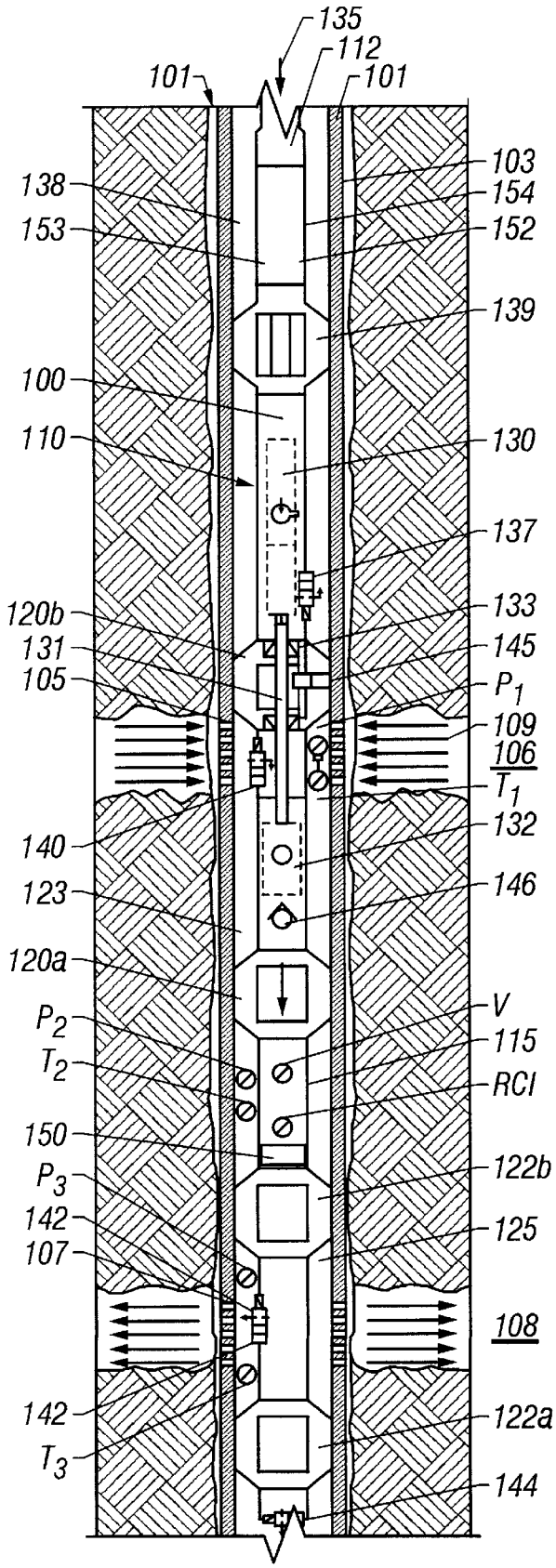
FIG. 3 shows a schematic elevational view of a cased well that has been prepared for production testing wherein formation fluid from a production zone is injected into an injection zone below the production zone.

FIG. 3 shows schematic elevation view of a cased well 101 that has been prepared for production testing according to one embodiment of the present invention. The well has been lined with a casing 103 that has perforations 105 adjacent a production zone or formation 106 to be tested and perforations 107 adjacent a permeable injection zone or formation 108. The test string 110 generally includes a bottom hole assembly 100 conveyed in the well 101 with a drill pipe 112. The bottom hole assembly 100 has a tubular member 115 that carries the various test devices. The test string 110 includes a lower packer or seal 120*a* and an upper packer 120*b* that respectively seal the annulus 123 between the tubing 115 (also referred to herein as the tubular channel or the channel) and the casing 103. This ensures flow of formation fluid 109 only into the tubing 115. Similarly, packers 122*a* and 122*b* seal the annulus 125 between the tubing 115 and the casing 103 below and above the perforations 107 ensuring that the fluid from the tubing 115 will only be pumped or injected into the formation 108.

The string 110 includes a motor 130 that drives a pump 132 disposed at a suitable location in the tubing 115. A drive shaft 131 coupled to the motor 130 passes through the packer or seal 120*b* and drives the pump 132. Seals 133 around the shaft 131 inhibit fluid communication through the packer 120*b*. The motor 130 preferably is a mud motor which is driven when drilling fluid or mud 135 supplied to the drill pipe 112 under pressure from the surface. The mud 135 drives the motor 130 and re-circulates or returns to the surface via the annulus 138 when a motor exit valve 137 is opened. The motor 130 may also be an electric motor or any other type of suitable motor. The motor may be a reversible type so that fluid may be pumped in either the uphole or downhole direction. A stabilizer/centralizer 139 may be provided above the motor 130 to provide lateral or radial stabilization to the string 110.

The test string 110 further includes a shut-in valve 140 which controls the flow of the fluid from formation 106 to the tubing 115. An injection valve 142 controls the fluid flow from the tubing 115 to the injection zone 108. A circulation valve 144 at the bottom of the tubing 115 may be provided to control fluid flow from the tubing 115 to the wellbore section below the string 110. A float valve 146 may be provided inside the rotor to prevent the back flow of the produced fluid 109. A bypass valve 145 is provided in the packer 120*b*. During tripping of the string 110 into the well 101, the bypass valve 145 is opened, which allows the mud 135 to return to the surface via the annulus between the tubing 115 and the casing 103 thereby cleaning the wellbore.

The string 110 includes a variety of sensors. Pressure sensors $P_1$, $P_2$ and $P_3$ respectively provide pressures in the tubing 115 adjacent the production zone 106, in the intermediate zone 110 and the injection zone 108. Temperature sensors $T_1$, $T_2$ and $T_3$ provide temperatures corresponding to the pressures $P_1$, $P_2$ and $P_3$. Flow measurement devices (flow meters) such as "V" provides fluid flow rate through the tubing 115. Other flow meters may be used to measure flow rates and to detect leaks.

A fluid sampler 150 (also referred to in the art as fluid collection chamber or system) may be provided on the high pressure side (i.e. past the pump 132) to collect fluid samples. A variety of fluid samplers are known. Any suitable sampling or collection chamber device may be utilized for the purpose of this invention. In addition to the conventional pressure, temperature and flow rate measurements, the string 110 preferably includes a number of other sensors for determining reservoir characteristics. Such sensors include sensors for determining viscosity, density, bubble point, composition and other chemical characteristics of the formation fluid. The sensors are generally denoted by "RCI" in FIG. 3. For motion evaluation, sensors such as resistivity sensors, acoustic and gamma ray sensors are disposed to provide parameters of interest of the formation. Such sensors may be conveniently placed above the motor 139. Such sensors are designated a measurement-while-drilling or "MWD" sensors and are denoted by numeral 152. A retrievable downhole memory unit 154 is preferably utilized to store the production testing data, which is downloaded at the surface for further analysis. The memory unit 154 can be retrieved by a wireline or coiled tubing if the string 110 gets stuck in the well.

To conduct the production test, the string 110 is conveyed into the wellbore. The packers 120*a* and 120*b*, 122*a* and 122*b* are set at the preferred locations. The precise location of the zones may be determined from the MWD sensors 154. The drilling fluid 135 is supplied under pressure, which rotates the motor that drives the pump 132. The mud 135 returns or re-circulates to the surface via the motor exit valve 139. The shut-in-valve 140 and the injection valves 142 are controllably opened to control the flow of the formation fluid from the production zone 106 to the injection zone 108. The pressure, temperature and flow measurements are continuously or periodically recorded into the memory 154. Electronic circuitry 153 preferably including microprocessor-based unit in the string 110 determines the values of various desired parameters from the downhole measurements. These measured values and data may be transmitted to a surface controller or processor which may be a computer system. The downhole processor and/or the surface control unit are programmed to control the various flow control devices, and may be programmed to control the fluid flow rate from the production zone 106 to the injection zone 108.

Once the first phase of the production test has been completed, the shut-in-valve and the injection valve are turned off, and the fluid communication between the production and injection zone stopped. The pressure in the zone 123 starts to rise. The pressure over time and temperature over time measurements are recorded until the pressure $P_1$ builds up to the formation pressure or for a selected time period.

As noted above, the production testing measurements may be recorded in downhole memory 154 and/or transmitted to a surface controller. The valves 137, 140, 142, 145, and 146 and other such devices are remotely controllable. The system can control the flow of fluid from the production zone 108 to the injection zone at any desired flow rate. The system is a closed loop system, wherein the operating parameters may be altered downhole, from the surface, or any other remote location.

Simultaneous to the pressure and temperature measurements of the production zone, pressure and temperature measurements for the injection zone also may be recorded, which provides data for characterizing the injection zone during a single trip. During the production testing phase, the fluid samples may be analyzed downhole by the reservoir characterization instruments ("RCI"). Fluid samples are collected by the sampler 150 and are analyzed upon retrieval of the string 110 to the surface.

Figure 4:
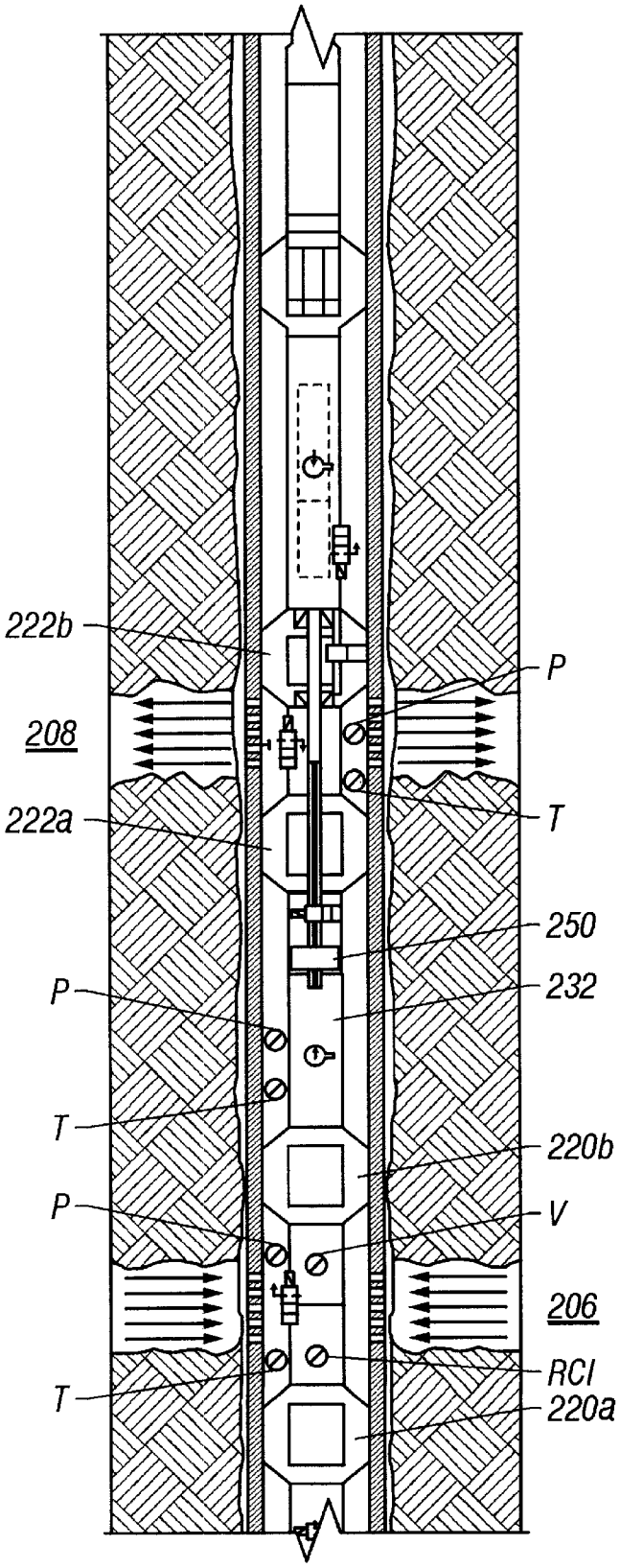
FIG. 4 shows a schematic elevational view of a cased well that has been prepared for production testing wherein formation fluid from a production zone is injected into a formation above the production zone.

FIG. 4 is an example of the implementation of production testing in a cased well wherein the production zone 206 is below or downhole of the injection zone 208. The operation of the various valves is the same as described above. The sampler 250 is disposed above the pump 232 since that is the high pressure side. In this configuration, the packers 220*a* and 220*b* isolate the production zone 206 while the packers 222*a* and 222*b* isolate the injection zone 208. For convenience the remaining elements are identified by the same numerals as shown in FIG. 3.

Figure 5:
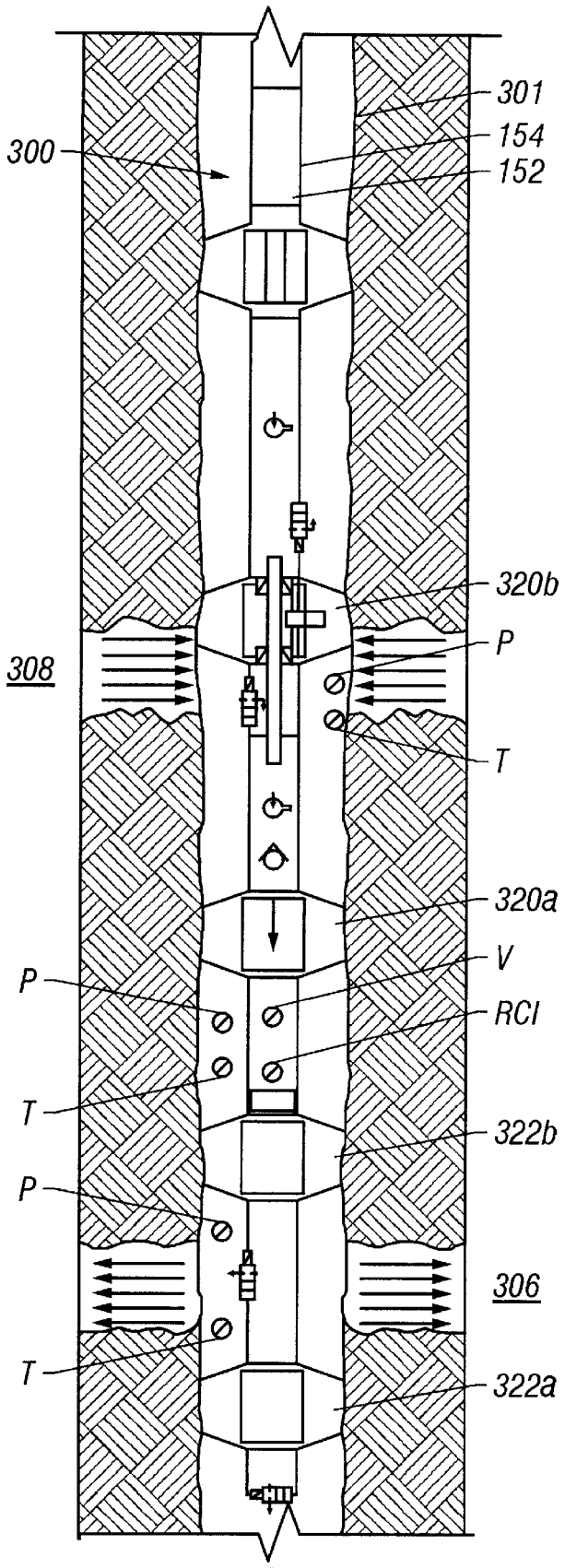
FIG. 5 shows a schematic elevation view of an open hole that has been prepared for production testing according to one method of the present invention.

FIG. 5 shows an example of implementation of the production testing method of the present invention in an open hole 301. The system 300 is substantially identical to the system described in reference to FIG. 4, except that suitable open hole packers and stabilizers are utilized. In FIG. 5, the open hole packers 320*a* and 320*b* isolate the production zone while packers 322*a* and 322*b* isolate the injection zone. Formation evaluation measurements made by the MWD sensors 152 may be utilized to precisely position the string 300 in the wellbore.

The above-described systems may be utilized when an upper portion of a well is cased with a lower open hole. Appropriate sealing devices, such as packers are utilized depending whether the well section is cased or not.

Figure 6A:
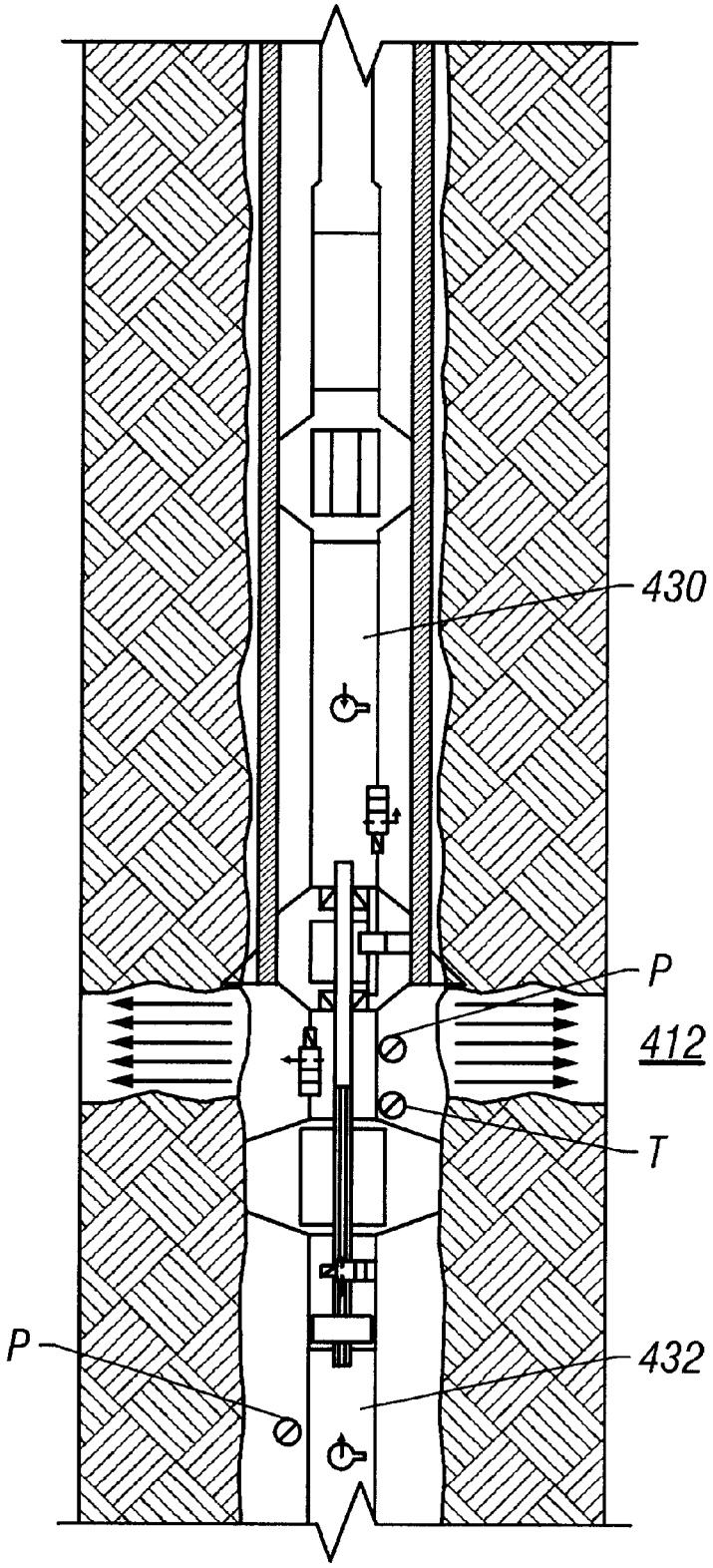
FIG. 6 (FIGS. 6A and 6B) shows a schematic elevation view of a wellbore with multiple production zones that has been prepared for production testing of one or more zones according to one method of the present invention.
Figure 6B:
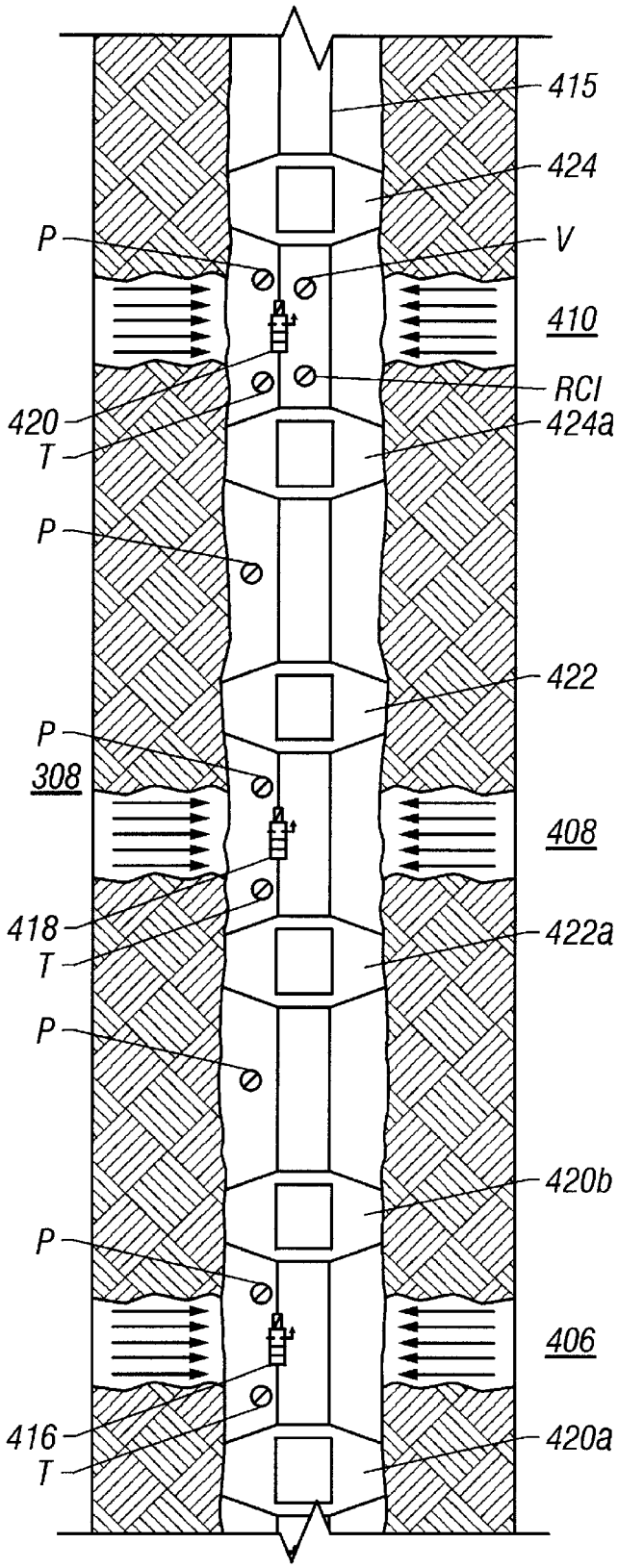

FIG. 6, which comprises FIGS. 6A and FIG. 6B, shows an implementation of the present method for testing multiple zones. FIG. 6 shows three production zones 406, 408 and 410 and one injection zone 412. Each of the production zones is isolated. For example, packers 420*a* and 420*b* isolate zone 406, packers 422*a* and 422*b* isolate zone 408 and packers 424*a* and 424*b* isolate zone 410. Each production zone has a corresponding shut-in-valve. Valves 416, 418 and 420 respectively control the flow from the production zones 406, 408 and 410 into the tubing 415. A common motor 430 and pump 432 may be utilized to pump the fluid from any of the producing zones into the injection zone 412.

To test a particular zone, for example 406, the shut-in-valves 418 and 420 are closed, while the valve 416 is opened. This only allows fluid from formation 406 to enter the tubing 415. This fluid is then pumped by the pump into the injection zone 412. The production testing is completed with respect to the zone 406 in the manner described above in reference to FIG. 5. To test the production zone 408, the zones 406 and 410 are shut off. The system of FIG. 6 also allows for testing zones sequentially or simultaneously. For example, any two of the three zones or all of the three zones may be tested simultaneously. The flow rate of each zone is independently controlled by the surface and/or downhole controller.

In the above-described systems, additional downhole instruments and sensors may easily be deployed. For example, one or more types of known fluid analysis devices may be disposed prior to the sample collection chamber (sampler) or they may be positioned at any other suitable location. Such sensors may include acoustic sensors, near infrared sensors, density measurement devices, chemical analysis devices etc. The system is adapted to control operations downhole and/or from the surface. The system provides the production testing measurements, fluid sampling and in-situ fluid analysis. Reservoir characterization instrumentation is disposed downhole to provide substantially real-time information.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A test string for in-situ testing a production zone intersecting a wellbore traversing a formation, comprising:

a fluid communication member adapted to allow fluid flow therethrough;

at least one first sealing device for isolating at least one production zone intersecting said wellbore to allow a fluid to flow from said at least one production zone into said fluid communication member;

at least one sealing device spaced apart from said at least one first sealing device for isolating at least one injection zone intersecting said wellbore;

a pump for pumping said fluid from said at least one production zone to said at least one injection zone through said fluid communication member;

one or more sensors for measuring one or more reservoir characteristics downhole;

a flow control device for controlling flow of said fluid from said at least one production zone; and a control unit for controlling said flow control device, wherein substantially all of said fluid remains in said production zone and said injection zone.

2. The test string of claim 1 further comprising at least one pressure sensor for measuring pressure of said fluid received from said production zone into said wellbore.

3. The test string of claim 2 further comprising a pressure sensor for measuring pressure of said injection zone.

4. The test string of claim 1 further comprising at least one sensor for providing a parameter of interest relating to a characteristic of said formation, said parameter of interest indicative of location of said production zone.

5. The test string of claim 1 further comprising a sensor for determining a characteristic of said fluid.

6. The test string of claim 5, wherein said sensor is selected from a group consisting of (i) a sensor for determining density of said fluid; (ii) a sensor for determining a chemical characteristic of said fluid; (iii) a sensor for determining viscosity of said fluid; and (iv) a sensor for determining composition of said fluid.

7. The test string of claim 1, wherein said first sealing device includes a set of spaced-apart packers.

8. The test string of claim 1 further comprising a motor that drives said pump.

9. The test string of claim 8, wherein said motor is selected from a group consisting of (i) a mud motor; and (ii) an electric motor.

10. The test string of claim 1 further comprising a memory unit that is adapted to store test data downhole.

11. The test string of claim 10, wherein said memory unit is retrievable from a location in said wellbore to a surface location.

12. The test string of claim 1 further having a second control unit at a surface location that is adapted to control flow of said fluid from said production zone into said injection zone.

13. The test string of claim 1, wherein said wellbore is one of (i) an open hole, (ii) a partially cased hole and (iii) a fully cased hole.

14. The test string of claim 1, further comprising a formation fracturing mechanism.

15. The test string of claim 14, wherein said formation fracturing mechanism is adapted to fracture said at least one production zone.

16. The test string of claim 14, wherein said formation fracturing mechanism is adapted to fracture said at least one injection zone.

17. The test string of claim 14, wherein said formation fracturing mechanism pulses said fluid to fracture said formation.

18. The test string of claim 1, further comprising a sensor disposed on said fluid communication member for measuring a production test parameter of interest.

19. The test string of claim 18, further comprising a processor located downhole for determining a value indicative of said production test parameter of interest.

20. A method of performing production testing of a production zone intersecting a wellbore traversing a formation comprising:

establishing an injection zone intersecting said wellbore of sufficient porosity and permeability to accept a body of production fluid supplied thereto under pressure;

isolating said production and injection zones and establishing a fluid communication path between said production and injection zones;

injecting said production fluid from said production zone into said injection zone at a known flow rate determining pressure of said production fluid in said communication path at least periodically over an extended time period;

discontinuing flow of said production fluid from said production zone to allow said production fluid pressure in said communication path to build up;

at least periodically measuring at least said production fluid pressure over a selected time period; and determining from said pressure measurements at least one characteristic of said production zone.

21. The method of claim 20, further comprising providing a sample collection device for collecting a sample portion of said body of production fluid.

22. The method of claim 20, wherein said injecting comprises providing a motor driven pump in said wellbore to pump fluid from said production zone into said injection zone.

23. The method of claim 20, further comprising fracturing said formation surrounding at least one of said injection zone and said production zone.

24. The method of claim 20, wherein determining said at least one characteristic of said production zone includes analyzing said pressure measurements downhole using a downhole processor.

* * * * *